US007463842B2

(12) United States Patent
Imada et al.

(10) Patent No.: US 7,463,842 B2
(45) Date of Patent: Dec. 9, 2008

(54) IMAGE FORMING APPARATUS WITH HOT AIR DISPERSING STRUCTURE

(75) Inventors: Takanoshin Imada, Saitama (JP); Yuichi Fujisawa, Saitama (JP); Masashi Sudo, Saitama (JP); Junichi Yumoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 170 days.

(21) Appl. No.: 11/202,137

(22) Filed: Aug. 12, 2005

(65) Prior Publication Data

US 2006/0182461 A1 Aug. 17, 2006

(30) Foreign Application Priority Data

Feb. 16, 2005 (JP) ..... 2005-039597

(51) Int. Cl.
*G03G 21/20* (2006.01)

(52) U.S. Cl. ..... 399/92; 399/107; 399/405

(58) Field of Classification Search ..... 399/92, 399/107, 405

See application file for complete search history.

(56) References Cited

U.S. PATENT DOCUMENTS 5,920,758 A 7/1999 Ohtsuki
6,112,040 A * 8/2000 Saito et al. ..... 399/93

FOREIGN PATENT DOCUMENTS

| | | | |
|---|---|---|---|
| CN | 1205458 A | | 1/1999 |
| JP | 2001236000 A | * | 8/2001 |
| JP | 2003-298792 A | | 10/2003 |
| KR | 2004-0085184 A | | 10/2004 |

* cited by examiner

*Primary Examiner*—David M. Gray
*Assistant Examiner*—Ryan D Walsh
(74) *Attorney, Agent, or Firm*—Sughrue Mion, PLLC

(57) ABSTRACT

An image forming apparatus is disclosed wherein an image reading portion is provided in spaced relationship with a top surface of an image forming portion. Further, in the apparatus: a supporting column portion is standingly provided on the image forming portion for supporting the image reading portion in a cantilevered manner; a tubular duct portion is provided inside the supporting column portion with an axial direction being substantially a vertical direction; an exhaust port is provided at the supporting column portion for exhausting air of the duct portion; and an intake port is provided below the exhaust port for delivering air from inside the image forming portion to the duct portion.

26 Claims, 19 Drawing Sheets

602
604A
604

600
602
J
C
C
612
J
J
604
610

602
614
604
604A

IMAGE FORMING APPARATUS WITH HOT AIR DISPERSING STRUCTURE

CROSS-REFERENCE TO RELATED APPLICATION

This application claims priority under 35 USC 119 from Japanese Patent Application No. 2005-39597, the disclosure of which is incorporated by reference herein.

BACKGROUND OF THE INVENTION

1. Field of the Invention

The present invention generally relates to an image forming apparatus, and more particularly to an image forming apparatus wherein an image reading portion is provided in a spaced relationship with a top surface of an image forming portion.

2. Description of Related Art

An image forming apparatus has been available which includes an image reading portion having a document table provided approximately above an image forming portion. In an image forming apparatus having such a structure, a structure has been proposed in which the surface of the document table of the image reading portion is positioned at an acute angle in order to prevent a temperature rise such that a heated atmosphere in the vicinity a fixing device and a recording paper discharge section is exhausted from an exhaust port provided in an obliquely upper rear surface (for example, refer to JP-A No. 2003-298792).

However, in the structure shown in FIG. 5 of the above-mentioned JP-A No. 2003-298792, since a duct including an intake vent (inlet port 205*a*) and an exhaust vent (outlet port 205*b*) is provided on a side surface of a supporting portion for supporting the image reading portion, there is concern that the strength of the supporting portion turns out to be insufficient.

SUMMARY OF THE INVENTION

The present invention has been made in view of the above circumstances and provides an image forming apparatus which prevents a temperature rise without decreasing the strength of a supporting column portion that supports an image reading portion.

A first aspect of the present invention provides an image forming apparatus wherein an image reading portion is provided in spaced relationship with a top surface of an image forming portion, the apparatus including: a supporting column portion standingly provided on the image forming portion and supporting the image reading portion in a cantilevered manner; a tubular duct portion provided inside the supporting column portion with an axial direction being substantially a vertical direction; an exhaust port provided in the supporting column portion for exhausting air of the duct portion; and an intake port provided below the exhaust port for delivering air from inside the image forming portion to the duct portion.

A second aspect of the present invention provides an image forming apparatus wherein an image reading portion is provided in spaced relationship with a top surface of an image forming portion, the apparatus including: a supporting column portion standingly provided on the image forming portion and supporting the image reading portion in a cantilevered manner; a tubular duct portion provided inside the supporting column portion with an axial direction being substantially a vertical direction; an exhaust port provided at the supporting column portion for exhausting air of the duct portion; and an intake port provided below the exhaust port for delivering air from inside the image forming portion to the duct portion; wherein the supporting column portion includes a supporting body having the duct portion, and wherein the supporting body is fixed to a housing of the image forming portion; wherein the supporting body includes: a first supporting portion provided with the duct portion and fixed to a side surface of the housing, for supporting the image reading portion; and a second supporting portion extending from the first supporting portion in a same direction as the cantilevered manner supported image reading portion; wherein a receiving portion for fixing the second supporting portion in place is provided on the side surface of the housing; and wherein the receiving portion is a frame body fixed to and standingly provided on the side surface of the housing; and wherein the second supporting portion is fixed to the frame body.

Other aspects, features and advantages of the present invention will become apparent from the following description taken in conjunction with the accompanying drawings.

BRIEF DESCRIPTION OF THE DRAWINGS

Preferred embodiments of the present invention will be described in detail based on the following figures, in which.

DETAILED DESCRIPTION OF THE INVENTION

Figure 1:
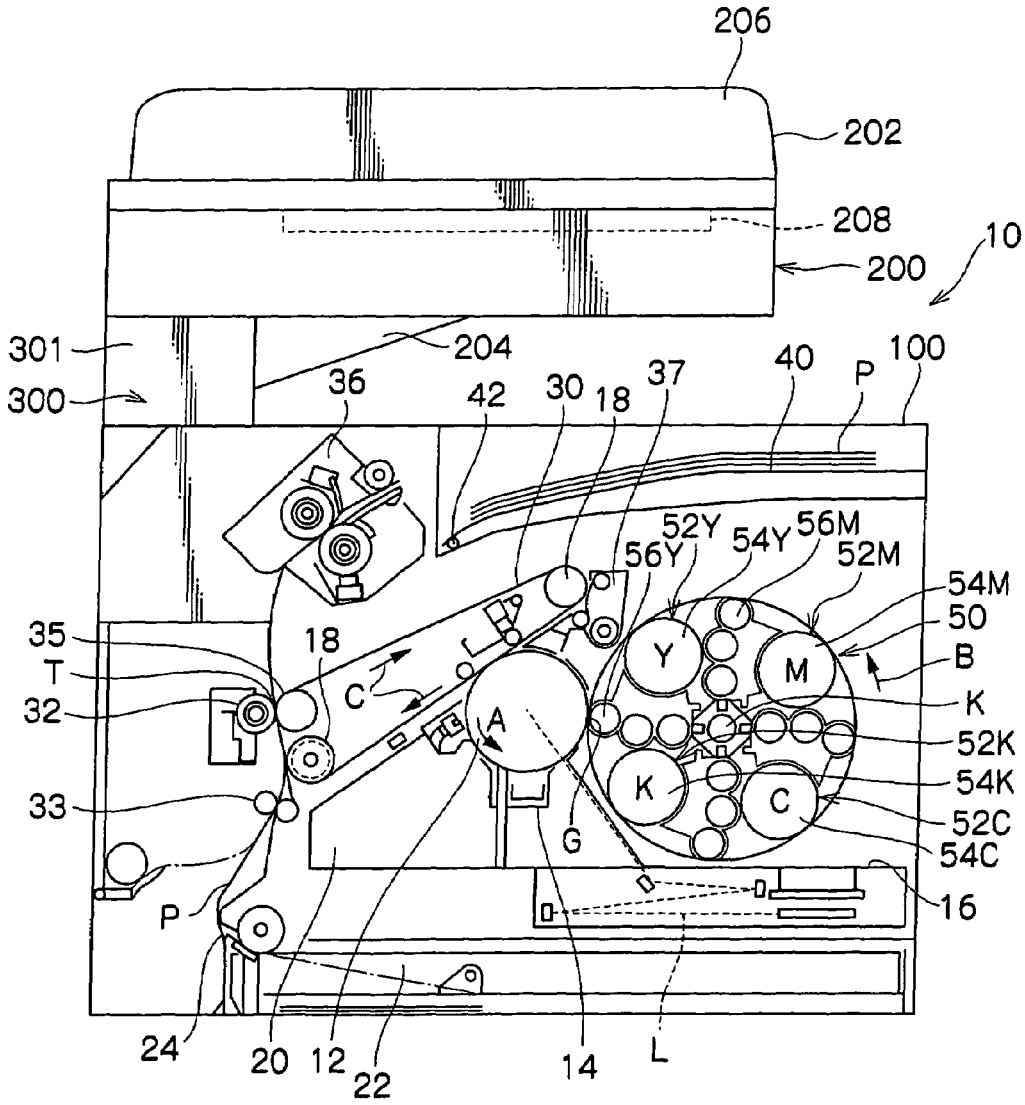
FIG. 1 is a diagrammatic view showing a digital copying machine according to an embodiment of the present invention.
Figure 3:
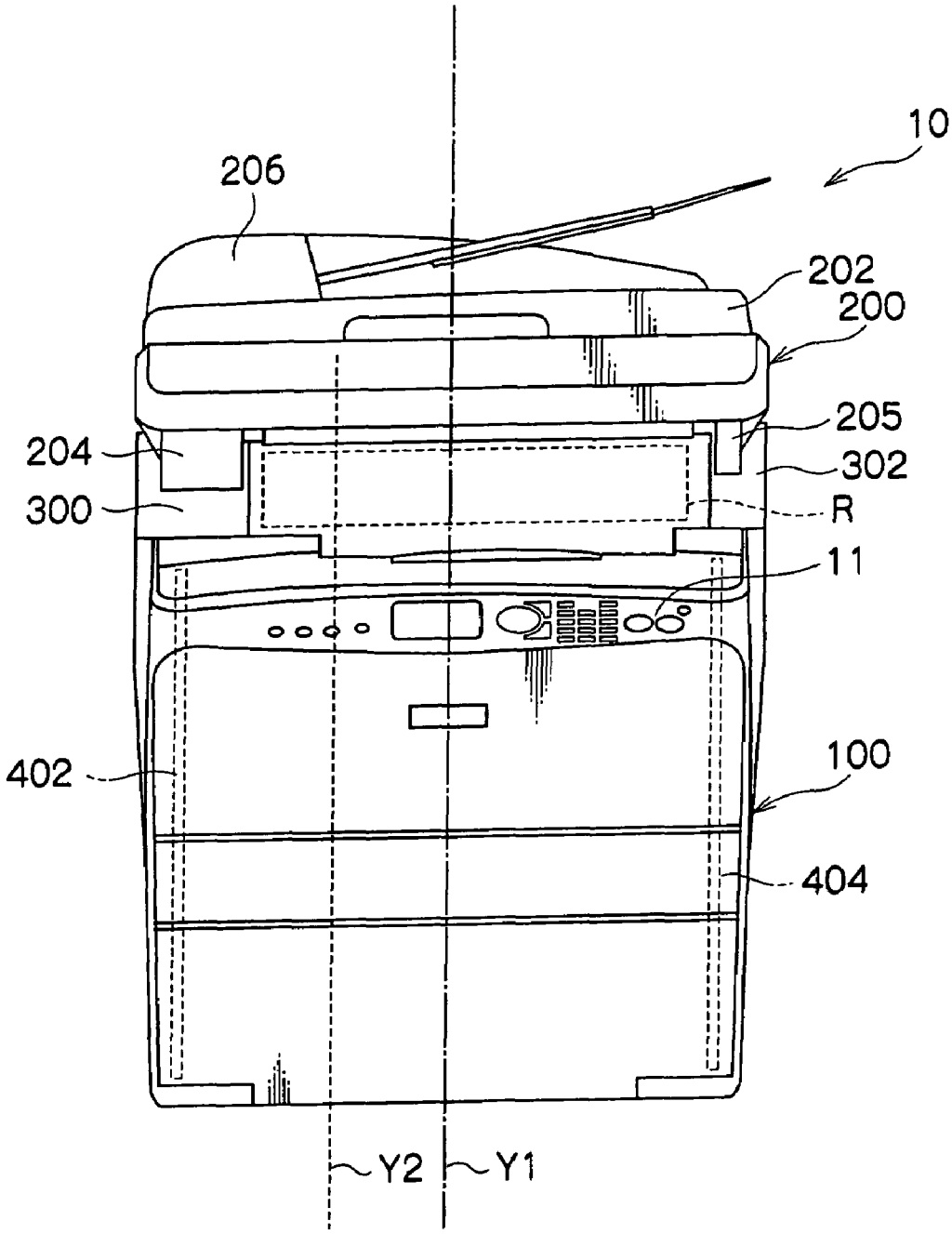
FIG. 3 is a front view of the digital copying machine.

As shown in FIGS. 1 and 3, a digital copying machine 10, which is an example of the image forming apparatus according to an embodiment of the present invention, is structured such that an image reading portion 200 is located in a cantilevered manner and in a spaced relationship with a catch tray 40 which constitutes an upper surface of an image forming portion 100. The image reading portion 200 reads and transforms a document to digital image data. The image forming portion 100 forms a full-color image on a recording paper P based on the read data and using toners of respective colors such as magenta (M), yellow (Y), cyan (C), and black (K) by a conventional xerographic process. Meanwhile, an operation panel 11 side where a user performs various operations as shown in FIG. 3 is the front side, and the opposite side is the back side.

Firstly, the image reading portion 200 will be described.

Figure 2:
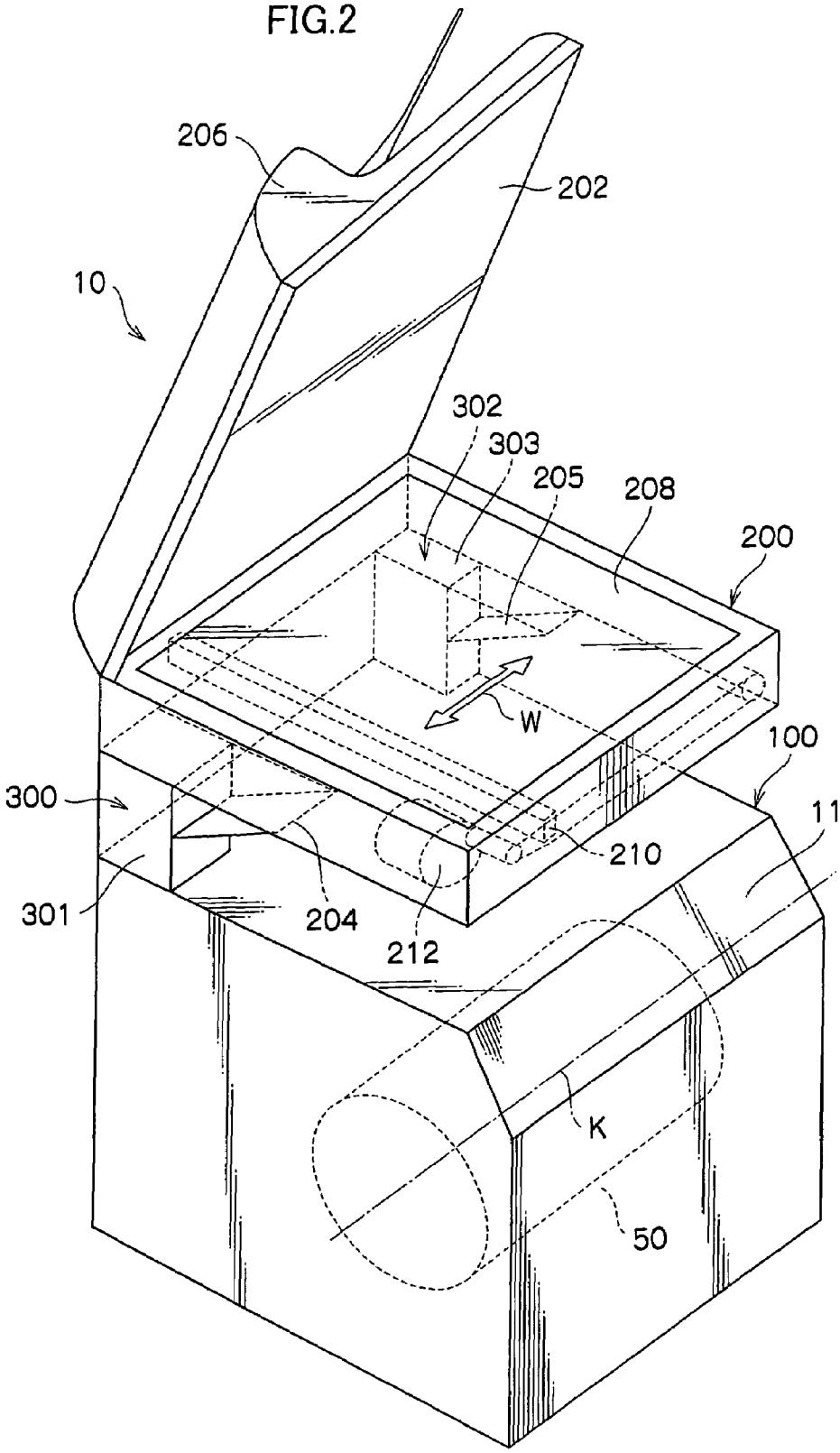
FIG. 2 is a perspective view diagrammatically showing a state in which a keep plate for an image reading portion of the digital copying machine is opened.

As shown in FIGS. 2 and 3, the image reading portion 200 has an approximately square configuration as seen in a plan view, with two rear corner portions thereof mounted on a first supporting column portion 300 and a second supporting column portion 302 which are uprightly provided at the rear corner portions of the image forming portion 100.

As shown in FIG. 2, a keep plate 202 at the top of the image reading portion 200 is turned to be opened. Below the keep plate 202 is provided a transparent document table 208 made of platen glass or the like for placing documents on the upper surface thereof. Further, an automatic document feed device 206 is provided above the keep plate 202. Below the document table 208 is provided a reading bar 210 constituted by CCD or the like which reads a document placed on the document table 208. The reading bar 210 is elongate from the front side to the rear side. Further, scanning in the direction of arrow W is performed by a scan driving mechanism 212 in order to read an image of the document placed on the document table 208.

Figure 4:
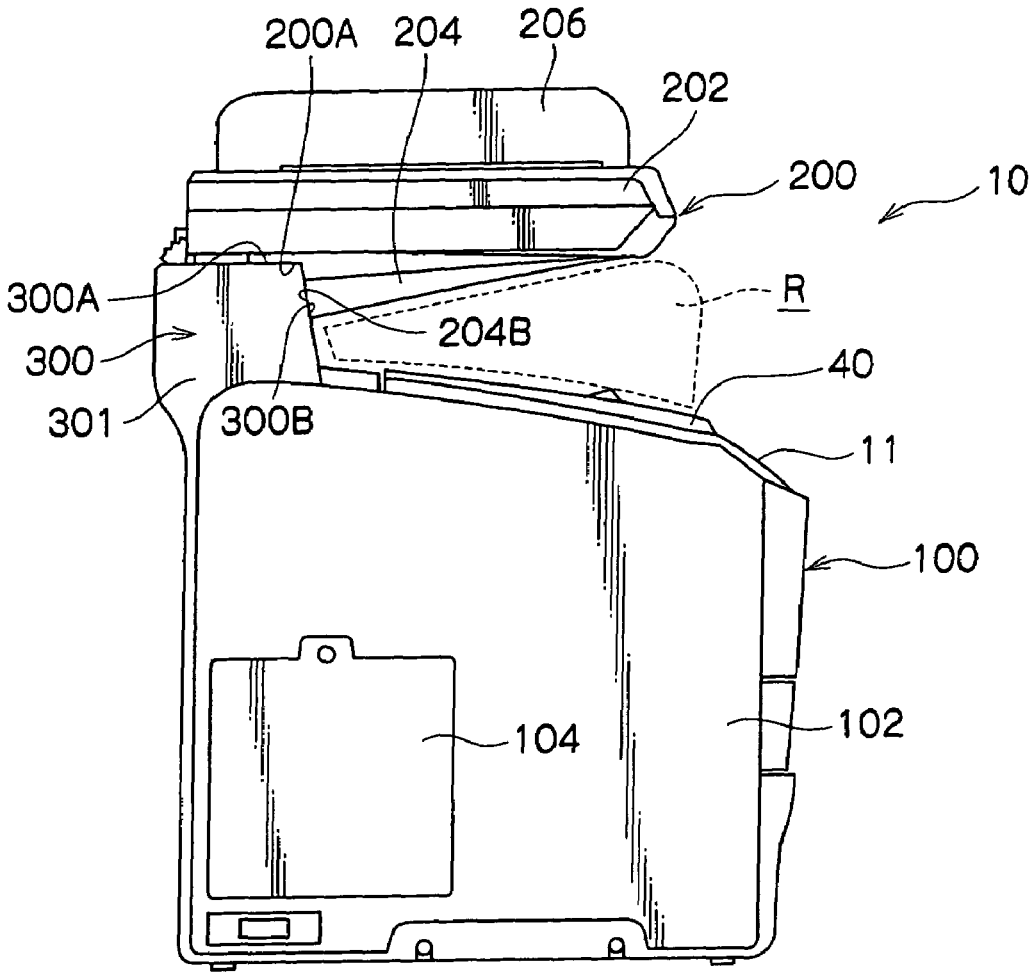
FIG. 4 is a side view of the digital copying machine.
Figure 5:
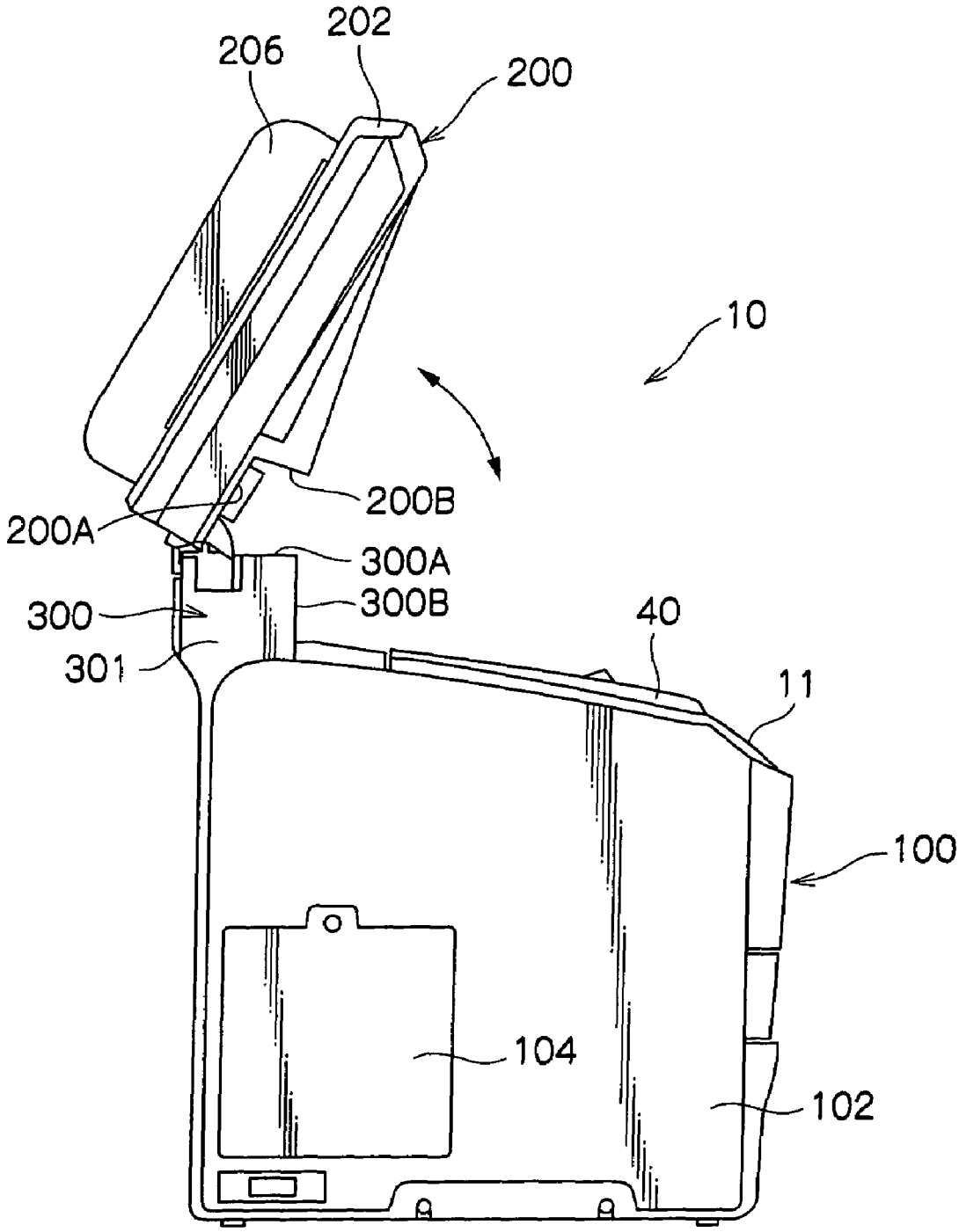
FIG. 5 is a side view of the digital copying machine showing a state in which the image reading portion is turned and opened.

Further, as shown in FIGS. 4 and 5, the image reading portion 200 is coupled to projecting portions 220 and 222 by hinges 224 and 226 (see FIG. 12A) such that the image reading portion 200 can be turned between a substantially horizontal position (FIG. 4) and an open position (FIG. 5). Thus, as shown in FIG. 5, when the image reading portion 200 as a whole is turned and opened, it is moved away from above the front face side of the image forming portion 100 such that a space is formed above the front face side.

As shown in FIG. 2, depending portions 204 and 205 are formed along the side edge portions of the image reading portion 200 and each of which has an inverted triangular shape whose bottom side is the side edge portion.

Further, as shown in FIG. 4, it is structured so that when the image reading portion 200 is in the substantially horizontal position (closed position), the image reading portion 200 rests on an upper surface 300A of the first supporting column portion 300, and further, a side face portion 204B of the depending portion 204 rests on a side face 300B of the first supporting column portion 300. Meanwhile, although no shown, the opposite side face is also similarly structured so that a lower surface 200A of a corner portion of the image reading portion 200 rests on an upper face 302A of the second supporting column portion 302 and further a side portion of the depending portion 205 rests on a side face 302B of the second supporting column 302.

Next, description will be made of the outline of the structure of the image forming portion 100 and the outline of a process for forming a full image on the recording paper P.

As shown in FIG. 1, a photoconductive drum 50 is rotatably provided at approximately the center of the image forming portion 100. Further, a rotary developing device 50 is provided at the front face side (right-hand side in FIG. 1) of the image forming portion 100.

The photoconductive drum 12 rotates in the direction of an arrow A. Further, the surface of the photoconductive drum 12 is charged to a predetermined potential by a charger 14 provided below the photoconductive drum 12, and subsequently exposure is performed by a laser beam L emitted from an optical scanning device 16 provided below the photoconductive drum 12 such that a latent image is formed on the surface of the photoconductive drum 12 based on the digital image data of the document read by the aforementioned image reading portion 200.

The latent image formed on the surface of the photoconductive drum 12 is transformed into toner images of predetermined colors by being developed by developing devices 52Y, 52M, 52C and 52K for the respective colors such as magenta (M), yellow (Y), cyan (C), and black (K). Meanwhile, the respective developing devices 52Y, 52M, 52C, and 52B include replaceable toner cartridges 54Y, 54M, 54C, and 54K, respectively.

The toner image formed on the surface of the photoconductive drum 12 is primarily transferred to an intermediate transfer belt 30 which is entrained about a plurality of rolls 18 and a transfer roll 35. Meanwhile, untransferred remnant toner left on the surface of the photoconductive drum 12, no being primarily transferred, is removed by a photoconductive drum cleaning device 20.

Meanwhile, the rotary developing device 50 is rotated about an axis of rotation K in the direction of an arrow B such that developing rolls 56Y, 56M, 56C, and 56K of the developing devices 52Y, 52M, 52C, and 52K for the respective colors corresponding to the colors of the image to be formed are sequentially moved to a development position G, thereby performing development of the respective colors.

Further, the steps of charging, exposure, development, primary transfer, and photoconductive drum cleaning are repeated a predetermined number of times depending on the colors of the image to be formed. Thus, images of the respective color toners are multiply transferred onto the intermediate transfer belt 30 in a superposed manner so that a full-color image is thereby formed.

Also, a paper feed cassette 22 in which recording paper P is accommodated is provided at the bottom of the image forming portion 100.

The recording paper P is fed out by a paper feed roller 24 and conveyed with a predetermined timing to a secondary transfer position T by resist rollers 33 such that the full-color toner images on the intermediate transfer belt 30 are secondarily transferred as one onto the recording paper P by a secondary transfer roll 32 and the transfer roll 35. Meanwhile, the untrasnferred remnant toner left on the intermediate transfer belt 30, not being secondarily transferred, is removed by a transfer belt cleaning device 37.

The recording paper P having the full-color image transferred thereto is conveyed to a fixing device 36 which is provided at the top of the rear side. The fixing device 36 fixes the full-color toner image to the recording paper P by means of heat and pressure. The recording paper P having the full-color image fixed thereto is discharged to the catch tray 40 at the top of the image forming portion 100.

Figure 11:
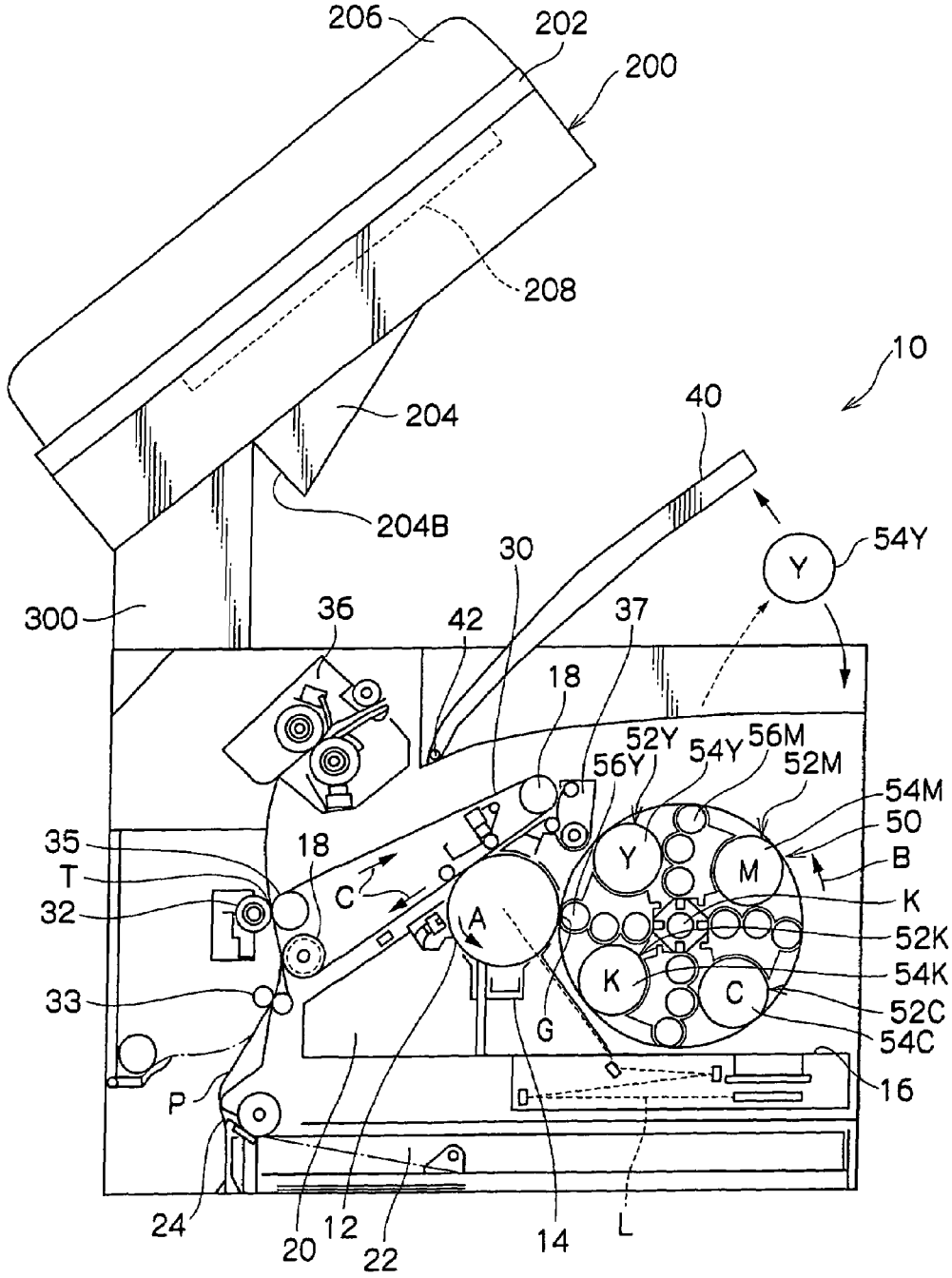
FIG. 11 is a view diagrammatically showing a manner in which a paper discharge tray is opened and a toner cartridge is exchanged, with the image reading portion of the digital copying machine turned and opened.

Now, as shown in FIG. 5, the image reading portion 200 as a whole is rotated so as to be moved away from the top of the front side of the image forming portion 100, and thus a space is formed above the front side of the image forming portion 100. Further, as shown in FIG. 11, the catch tray 40 is rotated about an axis of rotation 42 so as to be opened such that the toner cartridges 54 can be replaced. Meanwhile, although FIG. 11 illustrates a case where the toner cartridge 54Y us replaced, the other toner cartridges 54M, 54C, and 54K can also be replaced by rotating the rotary developing device 50 so as to cause the respective developing devices 52 to be moved to the position where the toner cartridge can be replaced.

Figure 6:
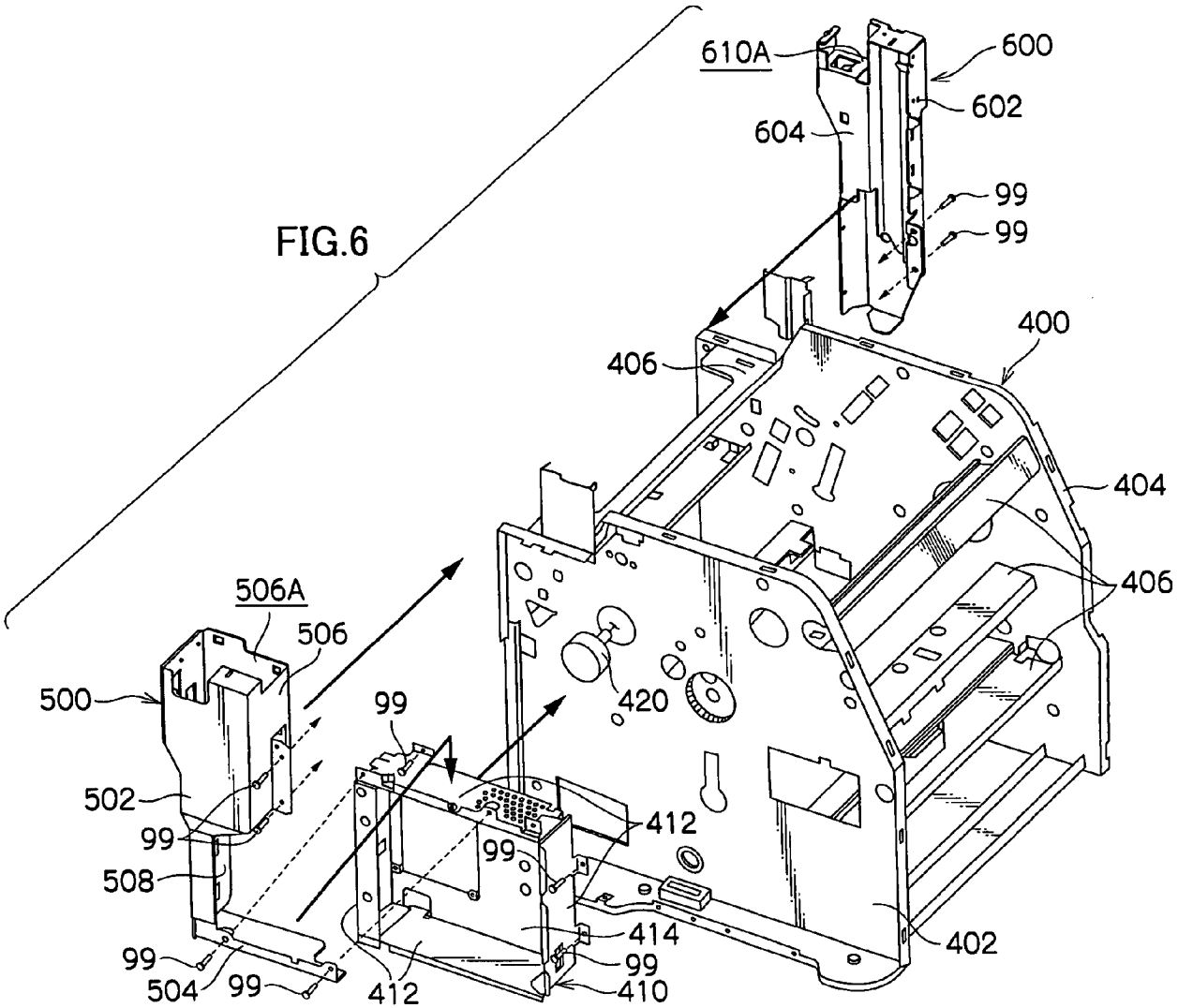
FIG. 6 is an exploded view showing a frame structure of the digital copying machine.
Figure 7:
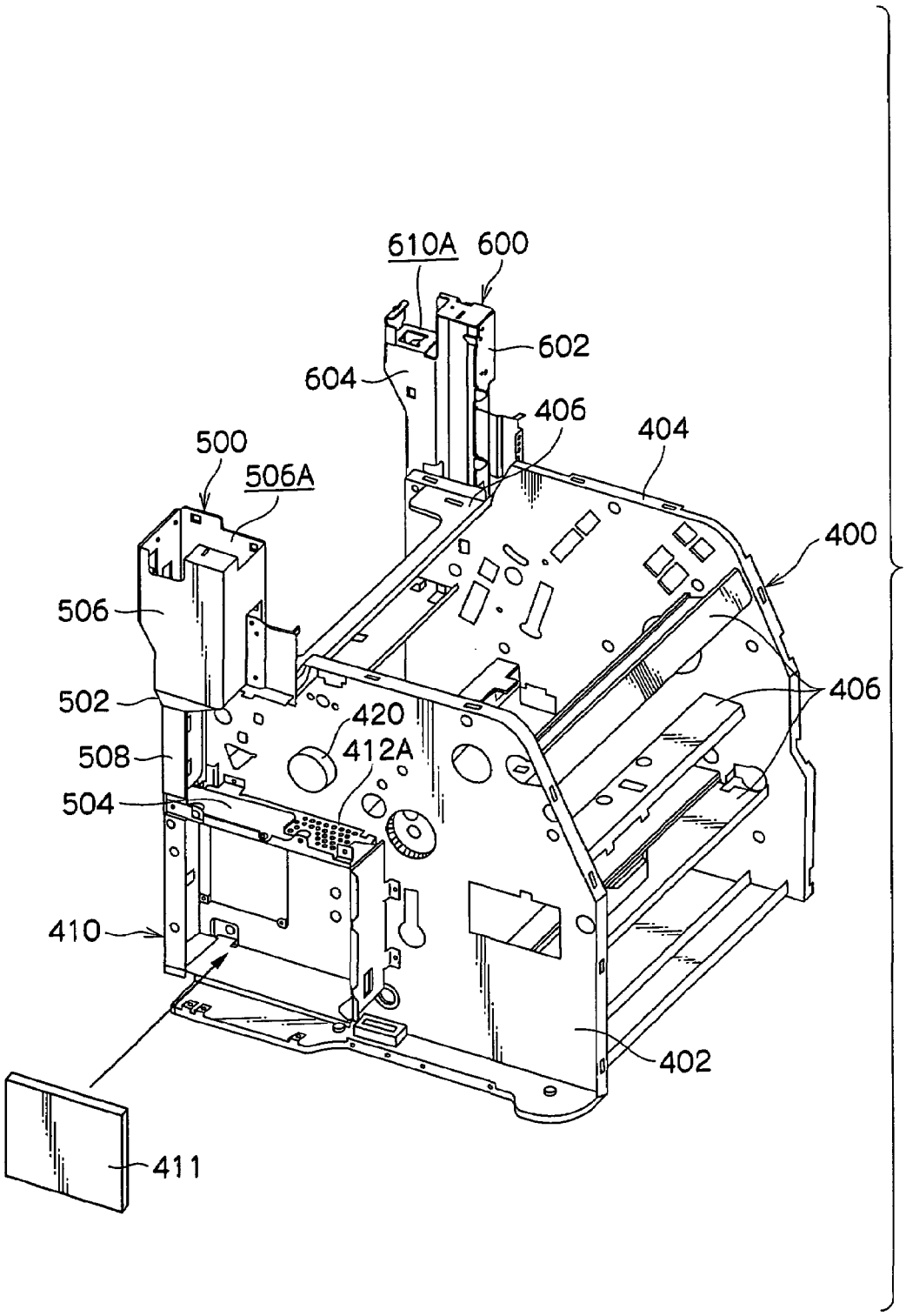
FIG. 7 is a view showing the frame structure of the digital copying machine.
Figure 8:
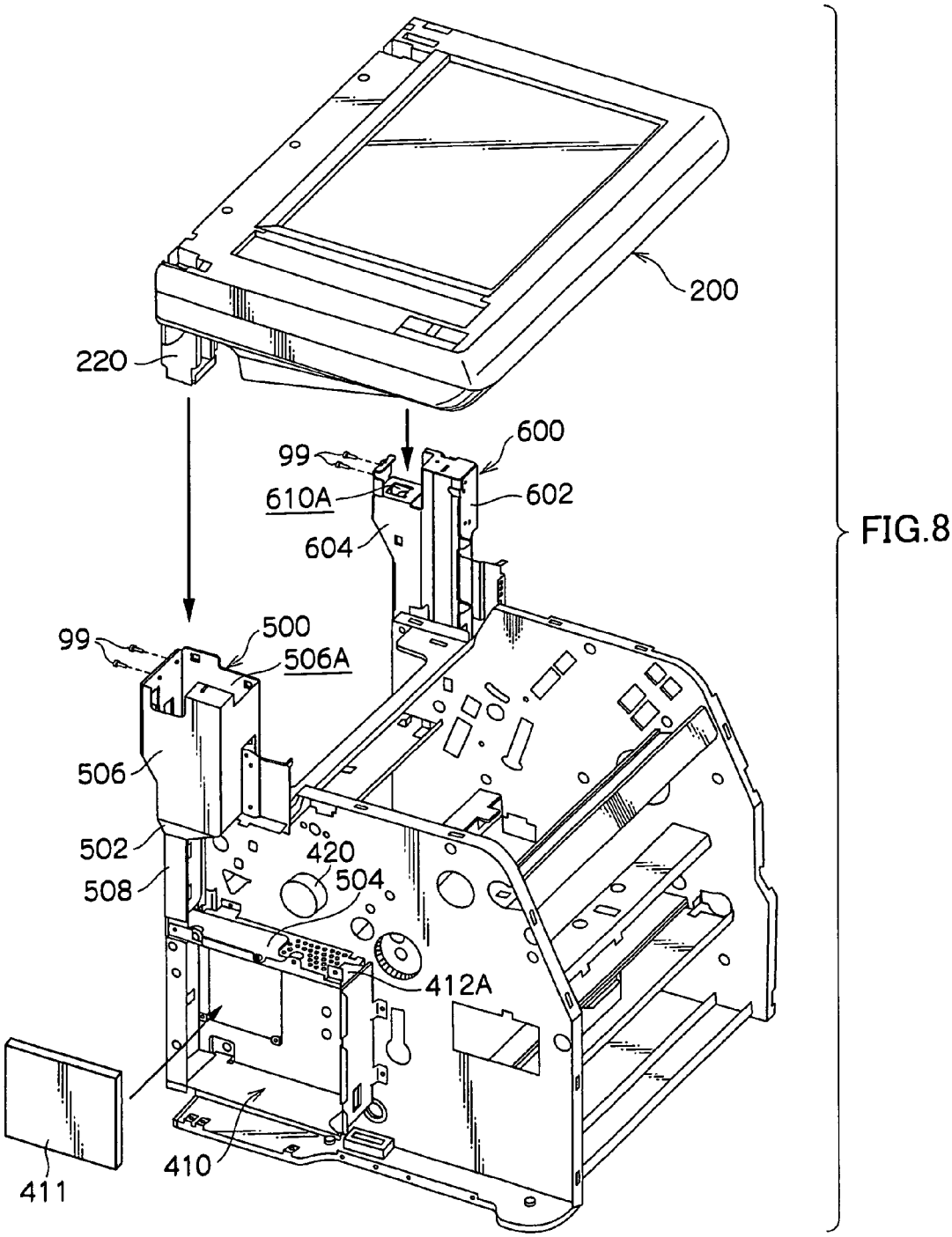
FIG. 8 is a view showing a manner in which the image reading portion is mounted on a first and a second supporting columns.

Next, description will be made of the support structure (frame structure) of the image reading portion 200 of the digital copying machine. FIGS. 6, 7, and 8 illustrate states in which various covers of the image forming portion 100 are removed.

Meanwhile, in the discussion below, it will be described that fixing is carried out using screws 99. However, in order to ensure that the views corresponding to the description do not become complicated and difficult to view, not all but only several typical ones of the screws 99 (and corresponding screw holes) are shown, and the other screws 99 (and corresponding screw holes) are not shown.

As shown in FIGS. 2 and 7, the first supporting column portion 300 internally includes a first supporting column 500 formed of metal plates (see FIG. 7), and the first supporting column 500 is enclosed by a first supporting column cover 301. Likewise, the second supporting column portion 302 internally includes a second supporting column 600 formed of metal plates (see FIG. 7), and the second supporting column 600 is enclosed by a second supporting column cover 303.

As shown in FIGS. 6 and 7, a housing 400 for the image forming portion 100 is comprised of opposing side plates 402 and 404 each formed of a metal plate, and a plurality of bridge plates 406 which are spanned between the opposing side plates 402 and 404.

Fixed to one of the side plates 402 is a box portion 410 which is configured in a box-like shape comprised of four side peripheral portions 412 and a bottom portion 414. Meanwhile, the box portion 410 is fixed by means of the screws 99 such that the bottom portion 414 is superposed on the side plate 402. Thus, it is structured that the side peripheral portions 412 are standingly provided on the side plate 402. Meanwhile, a power supply circuit board 411 may be installed in the box portion 410. Further, the power supply circuit board 411 can be easily replaced by a user by removing a detachable power supply cover 104 from a housing cover 102 covering the side plate 402 as shown in FIG. 4.

As shown in FIGS. 6 and 7, a driving motor 420 is fixedly provided above the box portion 410. Further, at the backside of the side plate 402 (inside the housing 400), a gear mechanism (not shown) is fixedly provided which is comprised of plural gears to which a driving force is transmitted from the driving motor 420.

Further, to the side plate 402 is securely fixed the first supporting column which is formed by bending and joining plural metal plates together. The first supporting column 500 is configured in an approximate L-shape which is formed by a first supporting portion 502, and a second supporting portion 504 extending in a horizontal direction from a lower portion of the first supporting portion 502 (in the same direction as the image reading portion 200). The first supporting portion 502 is comprised of a first box portion 506 configured in a hollow and square column-like shape having an opened top end, and a second box portion 508 provided below the first box portion 506 and which is configured in a hollow square column-like shape that is thinner than the first box portion 506. Meanwhile, both the first box portion 506 and the second box portion 508 are disposed such that the vertical direction is the length direction (axial direction).

The first supporting portion 502 is securely fixed to the side plate 402 by means of the screws 99. The second supporting portion 504 is superposed on a side peripheral portion 412A forming the top surface of the box portion 410 and securely fixed thereto by means of the screws 99. Further, the second supporting portion 504 is securely fixed in a state that does not interfere with the driving motor 420.

To the other side plate 404 is securely fixed the second supporting column 600 by means of the screws 99. Meanwhile, unlike the side plate 402, the side plate 404 does not have the box portion 410 and driving motor 420 fixed thereto, and thus the second supporting column 600 is configured so as to extend straight down to the lowermost end of the side plate 404.

Figures 9A, 9B, 9C:
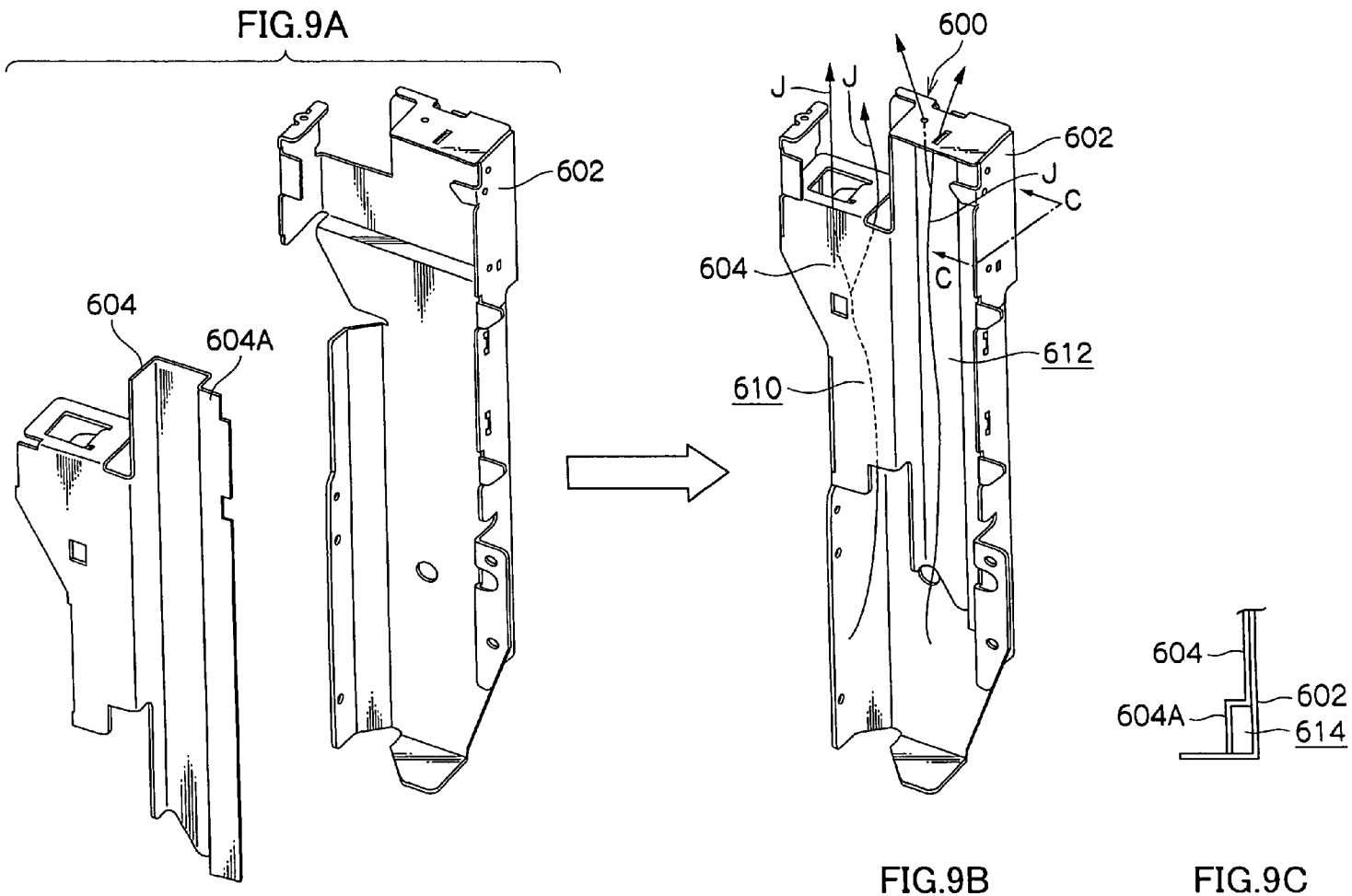
FIG. 9A is a diagrammatic view showing the second supporting column in a state before two metal pates are joined together.
FIG. 9B is a diagrammatic view showing the second supporting column in a state in which the two meal plates have been joined together.
FIG. 9C is a sectional view taken along the line C-C of FIG. 9B.

As shown in FIGS. 9A and 9B, the second supporting column 600 is configured in a hollow approximately square column-like shape in which two metal plates 602 and 604 subjected to a bending process are superposed and securely fixed together by means of the screws 99. Further, the upper portion of the second supporting column 600 is divided into two chamber portions 610 and 612. Still further, as shown in FIG. 9C, the metal plate 604 having a bent side end portion 604A, together with the other metal plate 602, forms a square column portion 614 having a hollow square column-like shape. Meanwhile, both the second supporting column 600 and the square column portion 614 are disposed such that the vertical direction is the length direction (axial direction).

Figure 10:
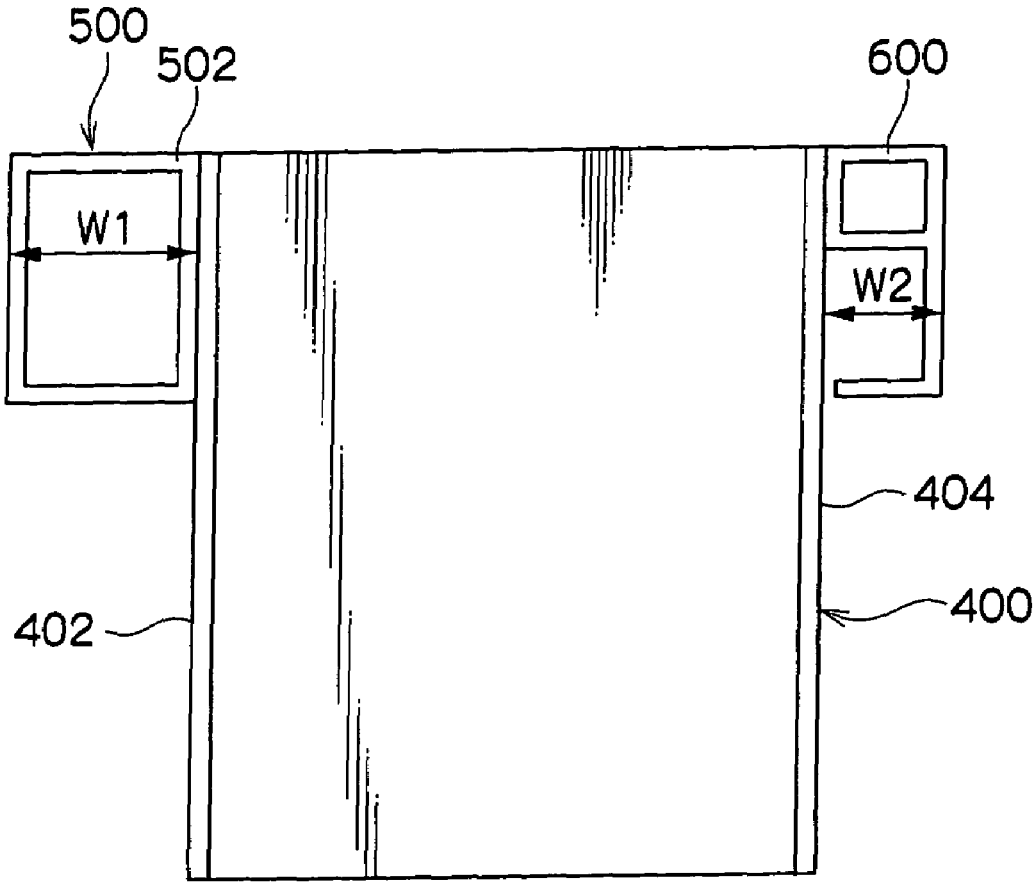
FIG. 10 is a diagrammatic view showing the difference in size between the cross-section of a first supporting portion of the first supporting column and the cross-section of the second supporting column.

As shown in FIG. 10, the horizontal cross-section of the first supporting portion 502 of the first supporting column 500 is larger (thicker) than that of the second supporting column 600. Specifically, the width in the front/rear direction (the vertical direction in FIG. 10) of the first supporting portion 502 is the same as that of the second supporting column 600, but the width in the left/right direction of the first supporting portion 502 is wider than that of the second supporting column 600. Meanwhile, in this embodiment, the width W1 of the first supporting portion 502 of the first supporting column 500 is two times as wide as the width W2 of the second supporting column 600.

Figures 12A, 12B:
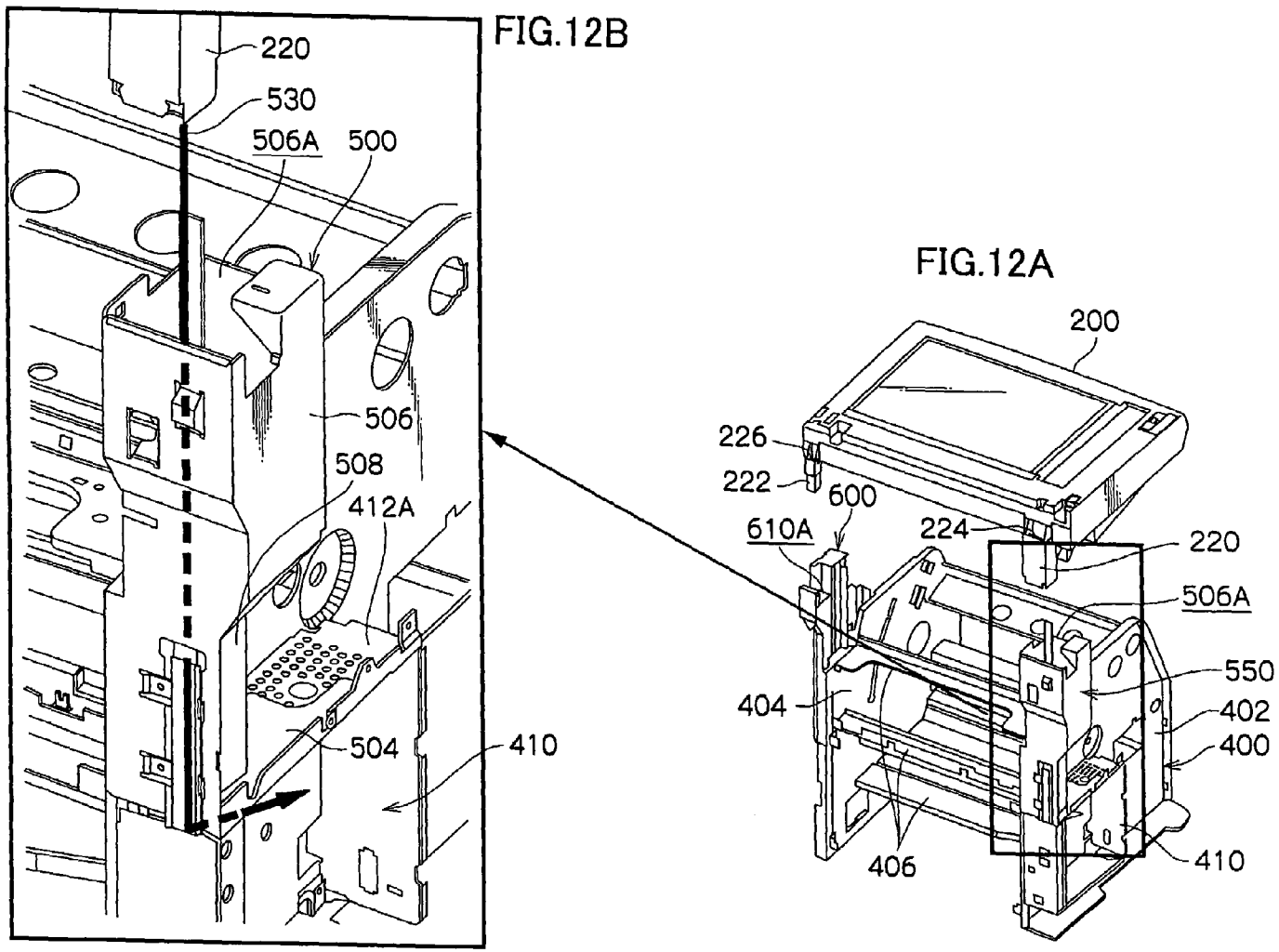
FIG. 12A is a view showing, from obliquely behind, a state in which the image reading portion is mounted on the first and second supporting columns.
FIG. 12B is an enlarged view showing the square portion of FIG. 12A.

As shown in FIGS. 8 and 12A, two projecting portions 220 and 222 (see FIG. 12A) projecting downward from the rear side corners of the image reading portion 200 are respectively inserted in an opening 506A at the top of the first supporting column 500 and an opening 610A at the top of the second supporting column 600, fitted in the first box portion 506 and the first chamber portion 610 and securely fixed by means of the screws 99. Thus, it is structured that the image reading portion 200 is supported in a cantilevered manner by the first supporting column 500 and the second supporting column 600.

Accordingly, as shown in FIGS. 3 and 4, the side portions between the image forming portion 100 and the image reading portion 200 are open (as indicated by portions enclosed by dotted lines in FIGS. 3 and 4) except for the depending portions 204, 205 and the first and second supporting columns 300, 302. The result of this is that the structure that has an excellent design Meanwhile, the image reading portion 200 is robustly structured so as to support the heavy document table 208, scan driving mechanism 212, automatic document feed device 206 and so forth (see FIG. 2). In addition, a high-strength member such as a beam or metal plate is bridged between the two projecting portions 220 and 222 (between the first supporting column 500 and the second supporting column 600) (see FIG. 12A). Thus, the image reading portion 200 is prevented from flexing even with a structure that is supported at two corners in a cantilevered manner by the first supporting column 500 and the second supporting column 600.

Further, as shown in FIGS. 2 and 3, both the automatic document feed device 206 and the scan driving mechanism 212 for causing the reading bar 210 to be scanned are located at the side plate 402 side. Thus, as shown in FIG. 3, the centre of gravity Y2 of the image reading portion 200 is located nearer to the side plate 402 than a center line Y1.

As described above, the image reading portion 200 is rotated about hinges 224 and 226 (see FIG. 12A) and opened.

As shown in FIG. 12B, an electric wire 530 connecting the power supply circuit board 411, attached to the above-described box portion 410 (see FIG. 8), and the image reading portion 200 extends through the interior of the first supporting column 500. Thus, the electric wire 530 is not exposed to the outside, and this is preferable appearance-wise.

Figures 13A, 13B:
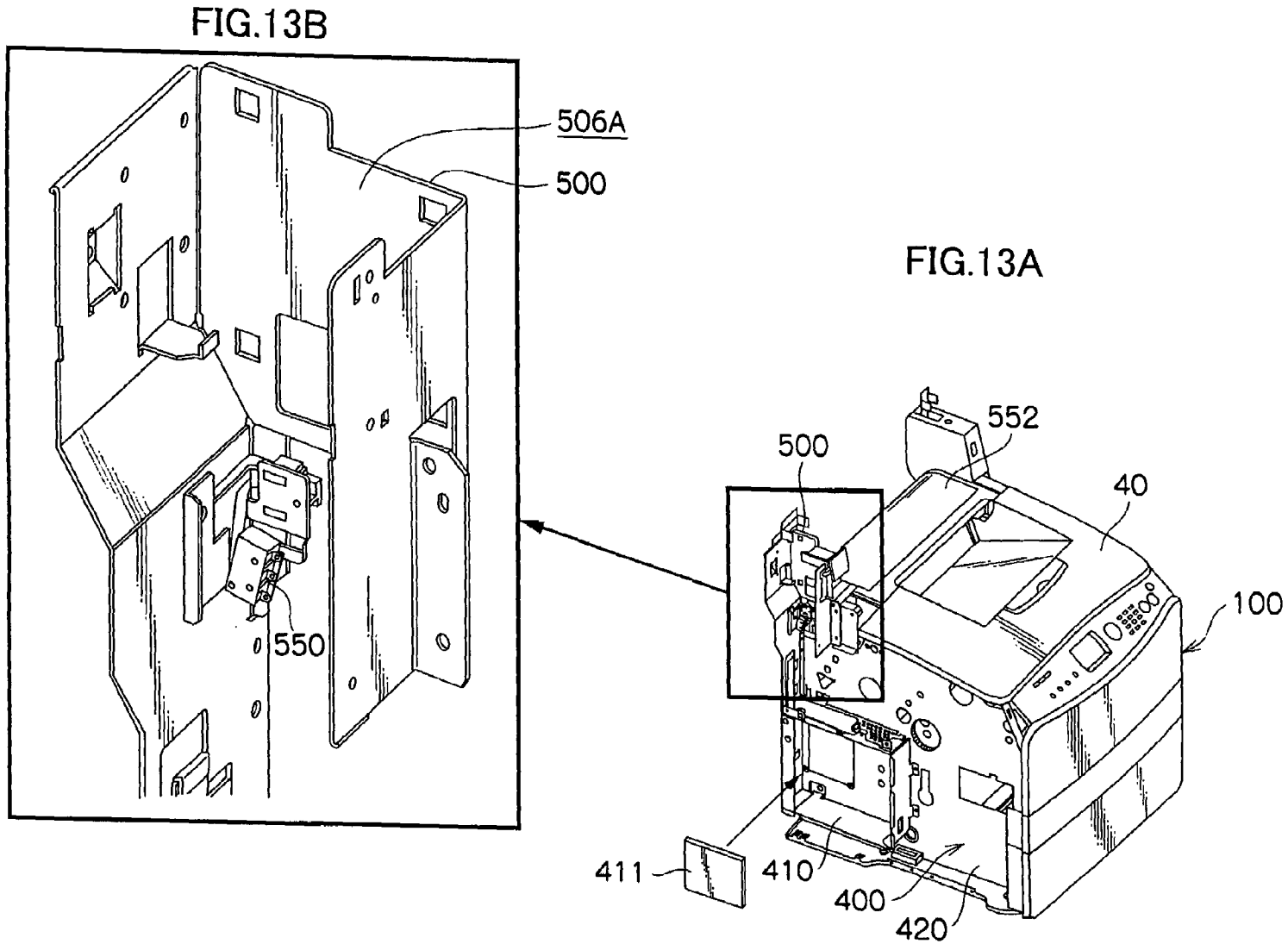
FIG. 13A is a view showing a state in which the image reading portion is not mounted.
FIG. 13B is an enlarged view showing the square portion of FIG. 13A.
Figure 14:
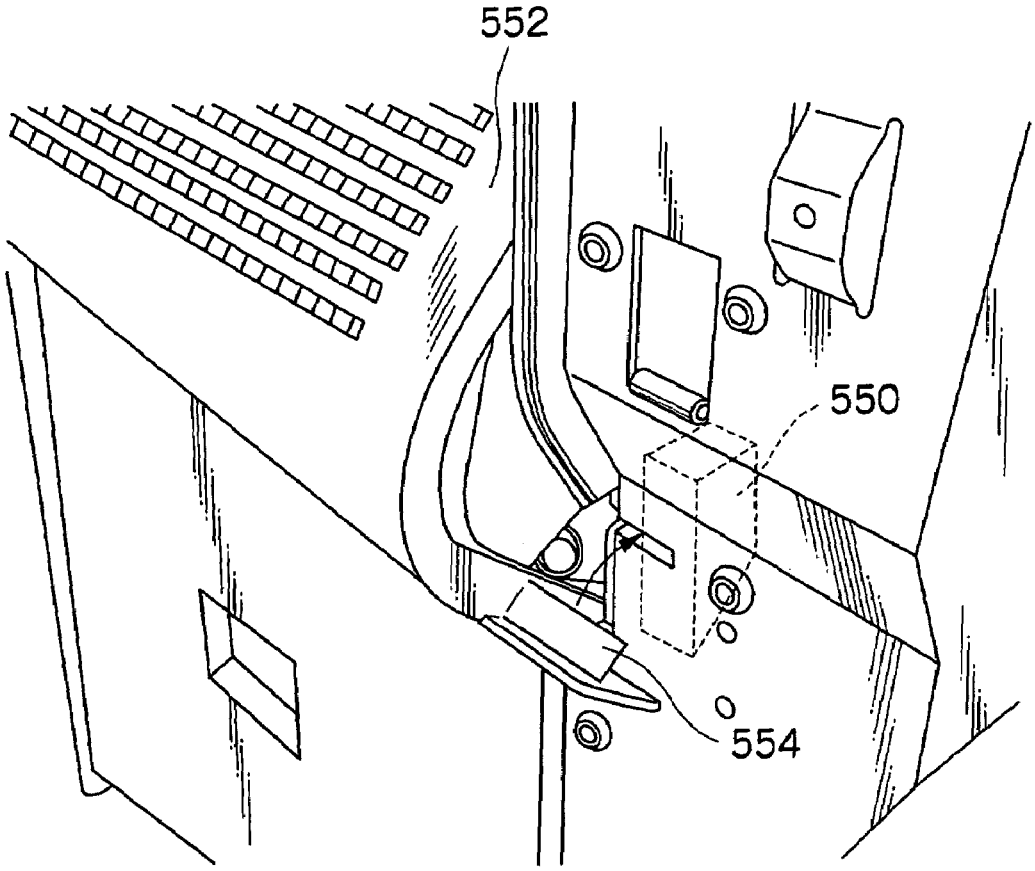
FIG. 14 is a view showing a state in which an opening/closing cover of a fixing device is open.

Further, as shown in FIG. 13B, a detection switch 550 is mounted inside the first supporting column 500. The detection switch 550 detects opening and closing of an opening/closing cover 550 which is provided outside of the fixing device 36 (see FIG. 1) located at the rear side top of the image forming portion 100. Specifically, as shown in FIG. 14, it is structured that detection is carried out due to the detecting switch 550 being turned on and off by a projecting portion 554, formed on the opening/closing cover 552, in response to the opening/closing cover 552 being opened and closed. When the cover 552 is opened (the state of FIG. 14), the power supply is turned off.

Figure 16:
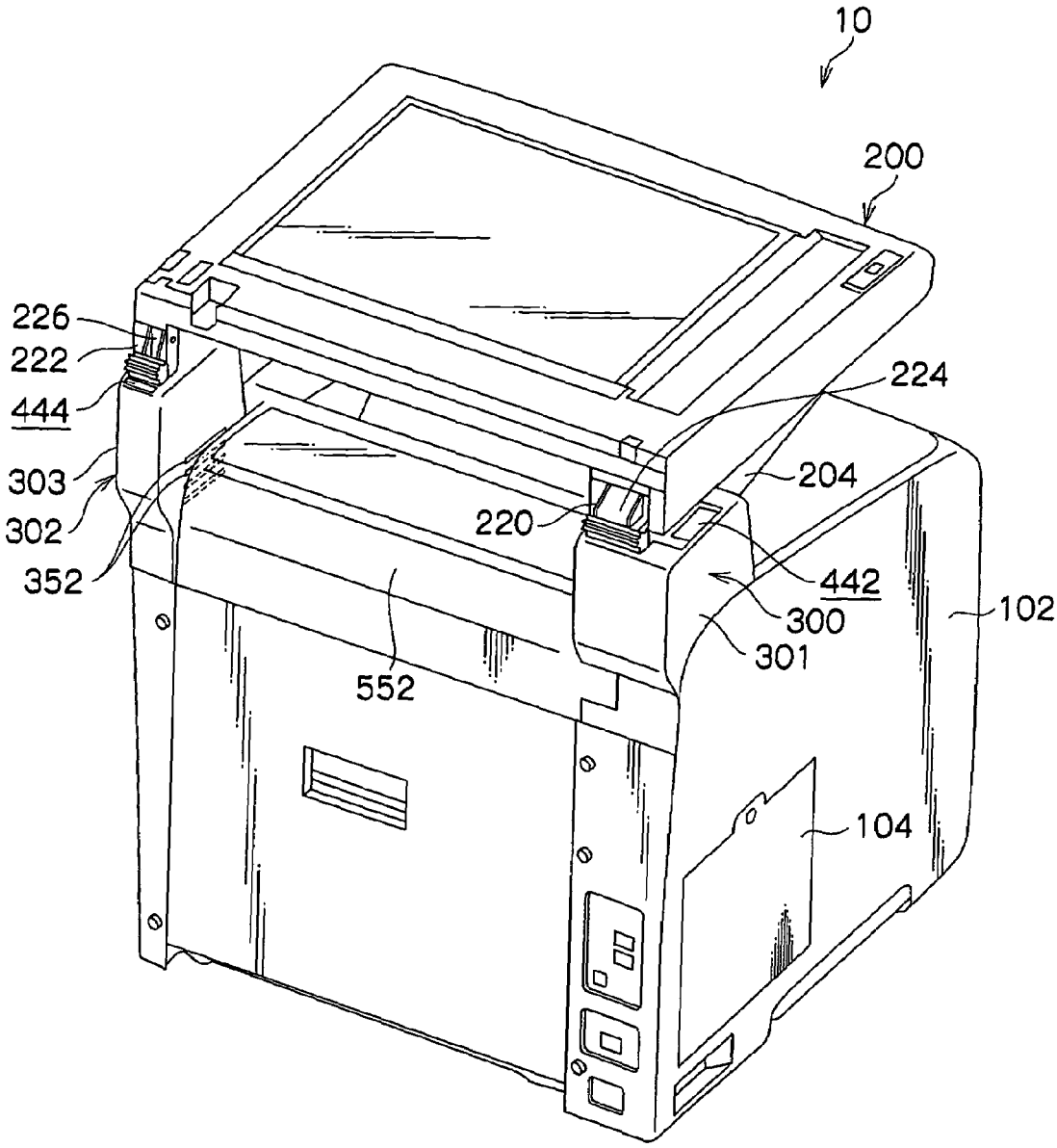
FIG. 16 is a perspective view showing the digital copying machine as viewed from obliquely behind.

As shown in FIG. 16, the housing cover 102 is mounted so as to enclose the housing 400. Further, the first supporting column 500 is enclosed by a first supporting column cover 301 mounted thereto, and the second supporting column 600 is enclosed by a second supporting column cover 303.

An exhaust port 442 is open at the top surface of the first supporting column cover 301, and an exhaust port 444 is open at the top surface of the second supporting column cover 303.

Figure 17A:
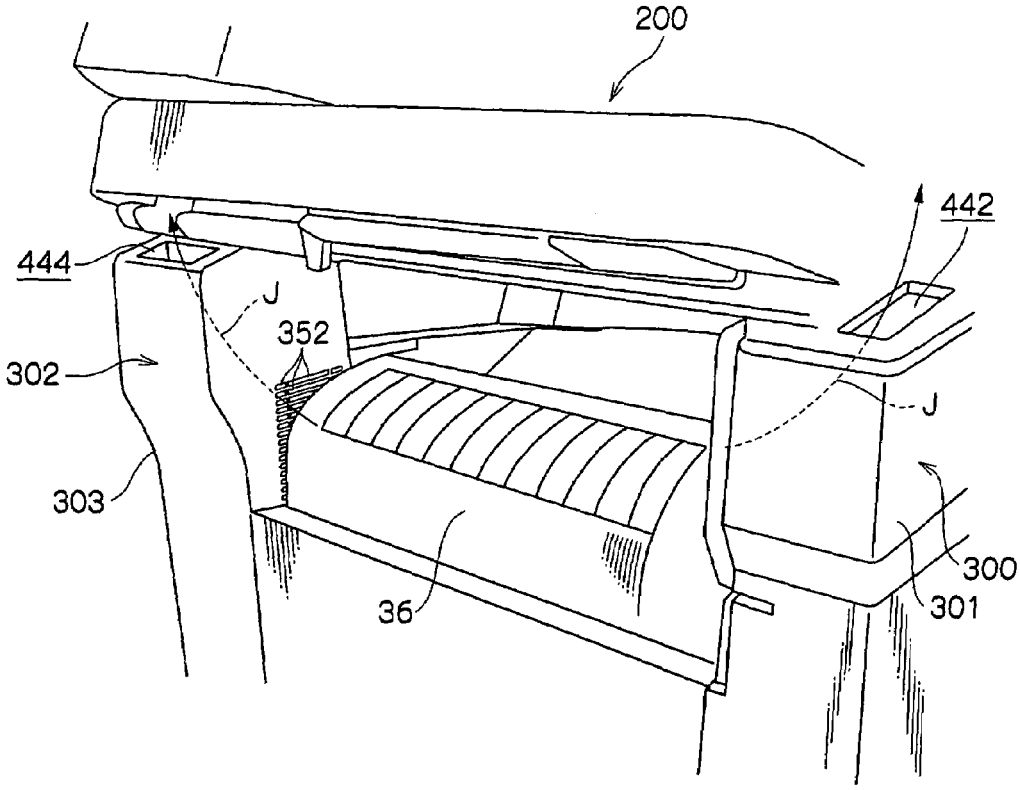
FIG. 17A is a perspective view showing a side surface of the second supporting column as viewed from obliquely behind.
Figure 17B:
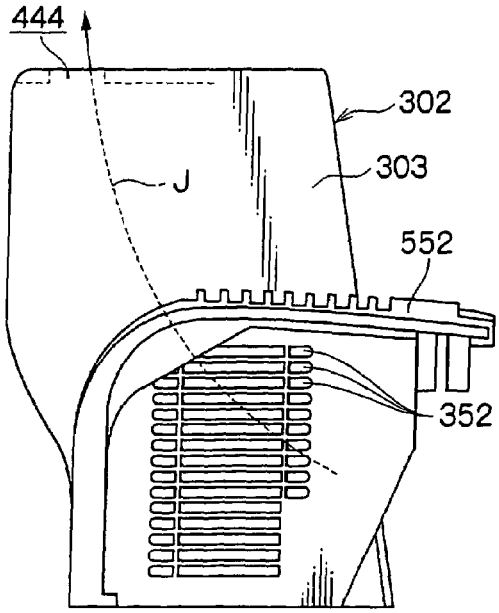
FIG. 17B is a side view of FIG. 17A.
Figure 18A:
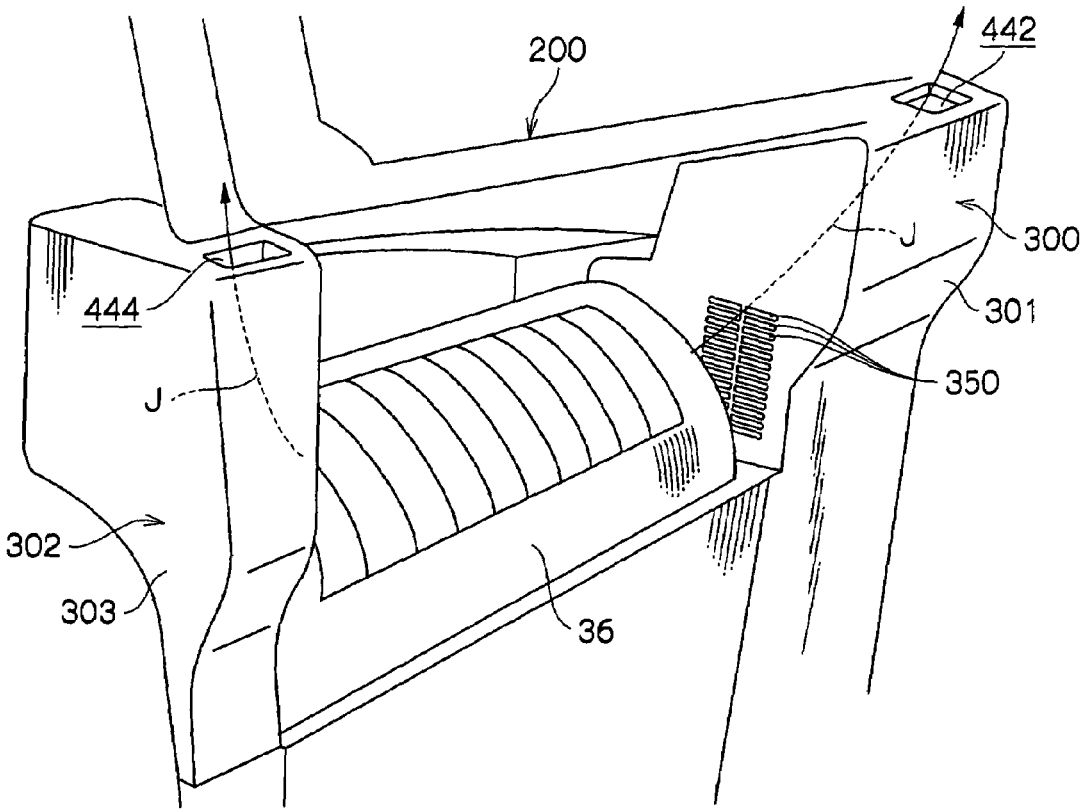
FIG. 18A is a perspective view showing side surface of the first supporting column from obliquely behind.
Figure 18B:
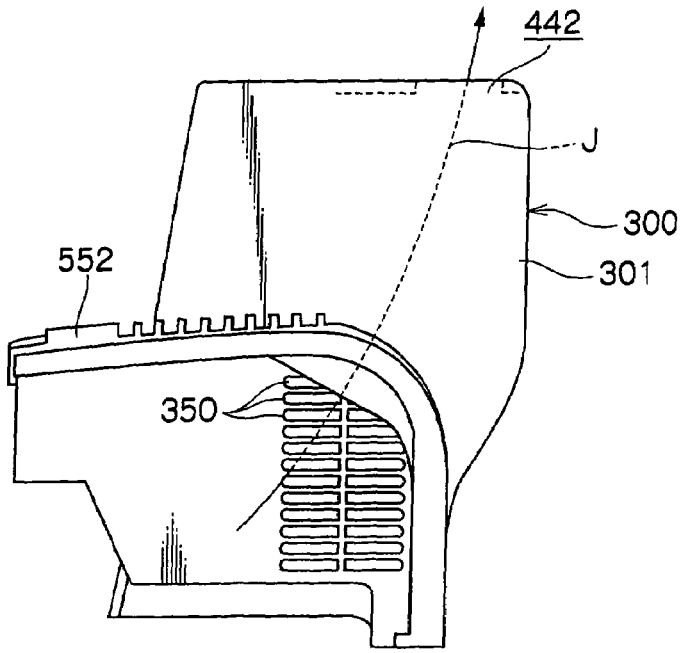
FIG. 18B is a side view of FIG. 18A.

Further, as shown in FIGS. 17A and 17B, slits 352 are formed in the inner side surface of the second supporting column cover 303. Similarly, as shown in FIGS. 18A and 18B, slits 350 are formed in the inner side surface of the first supporting column cover 301. For the sake of clarity, the opening/closing cover 552 provided outside of the above-mentioned fixing device 36 (see FIG. 1) is not shown in FIGS. 17A and 18*a*. Further, the fixing device 36 (see FIG. 1) is not shown in FIGS. 17B and 18B. Thus, the slits 350 and 352 are formed laterally of the fixing device 36 as shown in FIGS. 17A and 18A and inside of the opening/closing cover 552 as shown in FIGS. 17B and 18B.

Figure 19A:
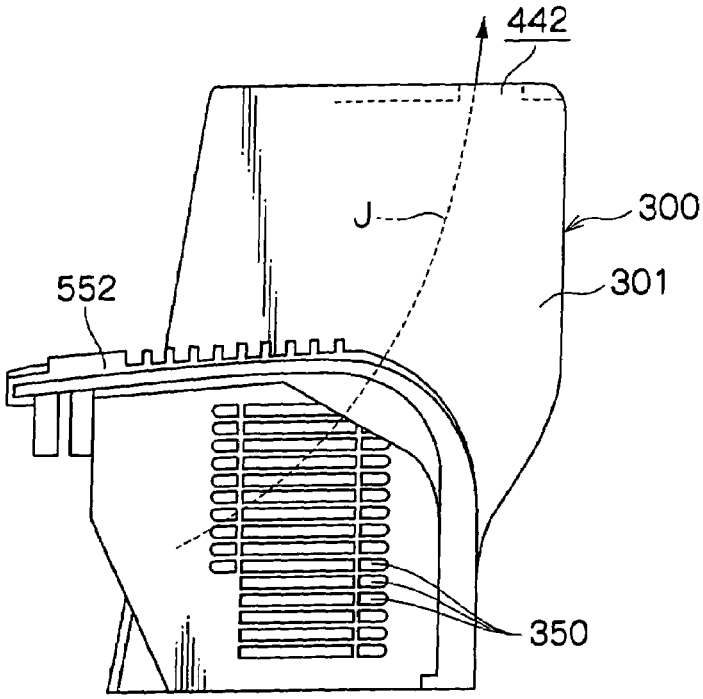
FIG. 19A is a side view of the first supporting column.
Figure 19B:
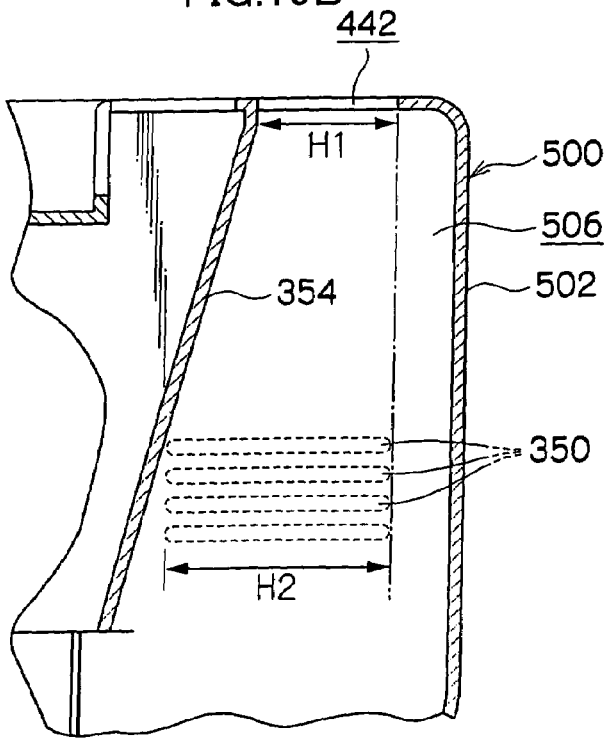
FIG. 19B is a view showing the interior of the first supporting column.

As shown in FIG. 19B, a rectifying plate 354 is provided inside the first box portion 506 of the first supporting portion 502 of the first supporting column 500. The rectifying plate 354 is disposed obliquely such that the upper space is narrower than the lower space (H1>H2).

Next, description will be made of the operation of this embodiment.

The fixing device 36 causes toner to be fixed by heating. Thus, the fixing device 36 acts as a heat source to heat the surrounding air. Further, the recording paper remains heated after the fixing process has been carried out by the fixing device 36, and hence the recording paper P also acts as a heat source to heat the surroundings when discharged to the catch tray 40 provided on the top surface of the image forming portion 100.

However, as mentioned above, the side portions between the image forming portion 100 and the image reading portion 200 are open except for the depending portions 204, 205 and the first supporting column portions 300, 302, as shown in FIGS. 3 and 4. For this reason, heat is not retained between the image reading portion 200 and the image forming portion 100.

Further, as shown by an arrow J in FIGS. 17A and 17B, the air heated by the fixing device 36 is allowed to flow from the slits 352 into the interior of the second supporting column portion 302. As shown by the arrow J in FIG. 19A, the heated air is allowed to flow upward through the first and second chamber portions 610 and 612 of the second supporting column 600. Subsequently, the heated air is allowed to flow out through gaps and apertures in the top surface of the second supporting column 600, and exhausted from the exhaust port 444 formed in the top surface of the second supporting column cover 303.

Similarly, as indicated by an arrow J in FIGS. 18A and 18B, the air heated by the fixing device 36 is allowed to flow from the slits 350 into the interior of the first supporting column portion 300. As shown in FIG. 19B, the heated air is allowed to flow upward through the first box portion 506 of the first supporting column 500. Subsequently, the heated air is allowed to flow out from gaps and apertures in the top surface of the first supporting column 500, and exhausted from the exhaust port 442 formed in the top surface of the first supporting column 301 as shown in FIGS. 18A and 18B. Meanwhile, as shown in FIG. 19B, since the interior of first box portion 506 is structured such that an upper space is made narrower than a lower space by the rectifying plate 354, the flowing speed of the air flowing through the first box portion 506 becomes higher as the air flows toward the upper space. This results in an increased exhaust efficiency.

Figure 15:
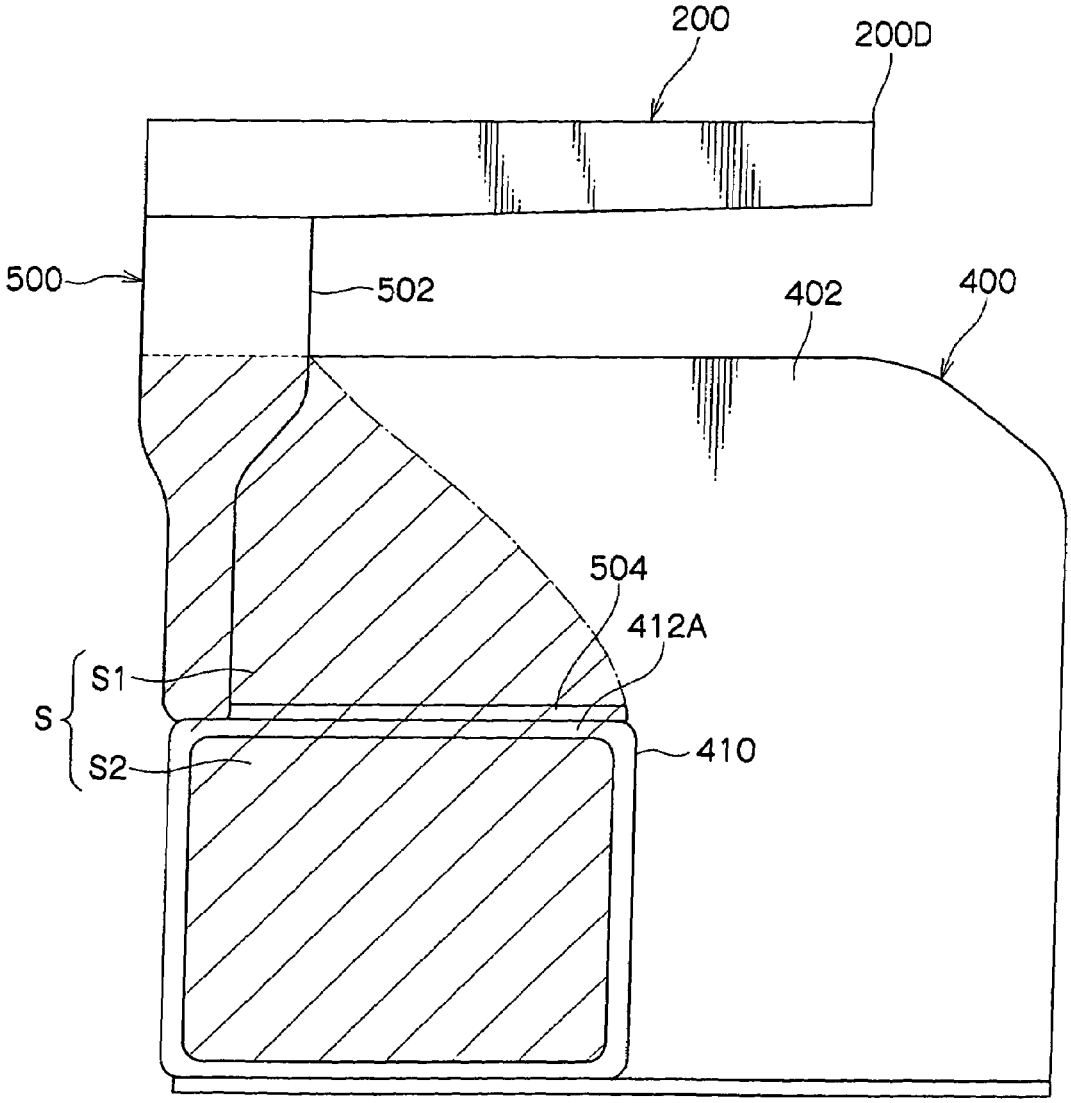
FIG. 15 is a diagrammatic side view showing the frame structure of the digital copying machine.

Further, as shown in FIG. 15 and FIG. 12B, the air in the interior of the box portion 410 is also heated, by the power supply circuit board 411. The air thus heated is allowed to flow in the second box portion 508 via a gap (corresponding to an air inlet port) in which the wire 530 is wired as shown in FIG. 12B, and thence flow upward from the second box portion 508 to the first box portion 506. Subsequently, the heated air is allowed to flow out from gaps and apertures in the top surface of the first supporting column 500, and exhausted from the exhaust port 442 formed in the top surface of the first supporting column 301 as shown in FIGS. 19A.

As will be appreciated, the interiors of the first and second supporting column portions 300 and 302 are used as ducts such that heated air is exhausted from the exhaust ports 442 and 444 efficiently due to a tunneling effect Further, since both the exhaust ports 442 and 444 are upwardly open, exhausting is more facilitated than in a case where exhaust ports are formed in a side surface, for example. In addition, since there is no need to provide a duct or ducts separately, space saving is achieved.

Further, by virtue of the structure in which the first and second supporting column portions 300 302 are located above the fixing device 36, as shown in FIGS. 16 through 18B, air heated by the fixing device 36 which generates a large quantity of heat is exhausted efficiently.

Further, assembling is facilitated by the assembling process in which the first and second supporting columns 500 and 600 are securely fixed to the side plate 402 of the housing 400 of the image forming portion 100 by means of the screws 99, and subsequently the two projecting portions 220 and 222 which project downwardly from the corners of the image reading portion 200 are inserted in the opening 506A at the top of the first supporting column 500 and the opening 610A at the top of the second supporting column 600 respectively, and fixed by means of the screws 99, as shown in FIGS. 6, 7, and 8.

Thus, the image reading portion 200 can be mounted using the housing 400 of the image forming portion 100 as it is. Accordingly, the digital copying machine 10 can be manufactured at a low cost.

Further, since the projecting portions 220 and 222 depending from the rear side corners of the image reading portion 200 are inserted and fitted in the opening 506A at the top of the first supporting column 500 and the opening 610A at the top of the second supporting column 600 and assembled by being fixed by means of the screws 99, the assembling of the first and second supporting columns 500 and 600 to the image reading portion 200 is facilitated.

Further, since all the components are fixed using the screws 99, they are readily detachable (can be easily disassembled).

Further, the image forming portion 100 on its own, with neither the image reading portion 200 nor the first and second supporting columns 500 and 600 mounted thereto, can be easily produced as a printer.

Further, as diagrammatically shown in FIG. 15, the first supporting portion 520 is fixed to the side plate 402, and the second supporting portion 504 extending in an approximately horizontal direction is fixed to the box portion 410 fixed to side plate 402. Thus, the box portion 410 also supports the image reading portion 200 in tandem with the first supporting column 500 (the box portion 410 also is a component to support the image reading portion 200.) Accordingly, the image reading portion 200 is supported by a wide section S including a triangular section S1 defined by the first supporting portion 502 and the second supporting portion 504 and a square section S2 of the box portion 410 such that there is a less likelihood that the side plate 402 is deformed, despite the first supporting portion 500 being fixed to the side plate 402. For this reason, despite the first supporting column being fixed to the side plate 402, no decrease in the quality of image is caused due to deformation of the housing 400 of the image forming portion 100.

Further, it is structured that the second supporting portion 504 extends in a horizontal direction (in the same direction as the image forming portion 100) and the peripheral side portion 412A constituting the top surface of the box portion 410 receives a force of the first supporting column 500 tending to fall toward the front side (the right hand side in FIG. 15). Thus, the image reading portion 200 is supported such that it is prevented from falling toward the front side. In addition, even if a load is imparted to a front side end portion 200D of the image reading portion 200, there is no possibility that the first supporting column 500 is easily caused to fall. Furthermore, as mentioned above, the side plate 402 is also less likely to be deformed.

Further, since the first supporting column 500 is structured such that it is securely fixed to the side plate 401, no beam is required for spanning the first and second supporting columns 500 and 600.

Further, the first supporting column 500 is securely fixed to the side plate 402 so as to support a substantial portion of the weight of the image reading portion 200. For this reason, the second supporting column 600 need not be fixed as securely as the first supporting column 500. Thus, although, unlike the first supporting column 500, the second supporting column 600 does not include the second supporting portion 504, as shown in FIG. 6, no problem arises. In fact, the second supporting column 600 has a high degree of freedom in design since it can be configured in any shape.

It is to be understood that the present invention is by no means limited to the above-described embodiment.

For example, although in the foregoing embodiments, the exhaust ports 442 and 444 have been provided in the top surfaces of the first and second supporting column portions 300 and 302 respectively, the present invention is not limited thereto. The exhaust ports 4421 and 444 may be formed in the side surfaces of the first and second supporting column portions 300 and 302 respectively. Further, instead of special exhaust ports being provided, gaps in the openings of the first and second supporting column covers 301 and 303, in which the projecting portions 220 and 222 of the image reading portion 200 are inserted, may be used so as to function as exhaust ports.

The second supporting column 600 may be configured in a manner similar to the first supporting column.

Although the present invention has been illustrated and described with respect to specific embodiments thereof, it should be understood that the present invention is by no means limited thereto and encompasses various changes and modifications which will become possible without departing from the spirit and scope of the present invention.

What is claimed is:

1. An image forming apparatus wherein an image reading portion is provided in spaced relationship with a top surface of an image forming portion, the apparatus comprising:

a supporting column portion provided on the image forming portion and supporting the image reading portion in a cantilevered manner;

a tubular duct portion provided inside the supporting column portion with an axial direction being substantially a vertical direction;

an exhaust port provided at the supporting column portion for exhausting air from the duct portion; and an intake port provided below the exhaust port for delivering air from inside the image forming portion to the duct portion, wherein the supporting column portion comprises a supporting body having the duct portion, and wherein the supporting body is fixed to a top portion of a housing of the image forming portion.

2. The image forming apparatus according to claim 1, wherein the duct portion is made from a metal.

3. The image forming apparatus according to claim 1, wherein the exhaust portion is open toward the top direction.

4. The image forming apparatus according to claim 2, wherein the exhaust portion is open toward the top direction.

5. The image forming apparatus according to claim 4, wherein a projecting portion projecting from the image reading portion is inserted in an insertion portion provided in the supporting column portion.

6. The image forming apparatus according to claim 5, wherein the supporting column portion comprises a supporting body having the duct portion, and wherein the supporting body is fixed to a housing of the image forming portion.

7. The image forming apparatus according to claim 6, wherein the supporting body comprises:

a first supporting portion provided with the duct portion and fixed to a side surface of the housing for supporting the image reading portion; and a second supporting portion extending from the first supporting portion in the same direction as the cantilevered manner supported image reading portion;

wherein a receiving portion for fixing the second supporting portion in place is provided on the side surface of the housing.

8. The image forming apparatus according to claim 7, wherein the receiving portion is a frame body fixed to and provided on the side surface of the housing, and wherein the second supporting portion is fixed to the frame body.

9. The image forming apparatus according to claim 3, wherein a projecting portion projecting from the image reading portion is inserted in an insertion portion provided in the supporting column portion.

10. The image forming apparatus according to claim 9, wherein the supporting column portion comprises a supporting body having the duct portion, and wherein the supporting body is fixed to a housing of the image forming portion.

11. The image forming apparatus according to claim 10, wherein the supporting body comprises:

a first supporting portion provided with the duct portion and fixed to a side surface of the housing for supporting the image reading portion; and a second supporting portion extending from the first supporting portion in the same direction as the cantilevered manner supported image reading portion;

wherein a receiving portion for fixing the second supporting portion in place is provided on the side surface of the housing.

12. The image forming apparatus according to claim 11, wherein the receiving portion is a frame body fixed to and provided on the side surface of the housing, and wherein the second supporting portion is fixed to the frame body.

13. The image forming apparatus according to claim 1, wherein the intake port is provided in the vicinity of a heat source.

14. The image forming apparatus according to claim 13, wherein the heat source is an electric circuit board.

15. The image forming apparatus according to claim 13, wherein the heat source is a fixing device that causes toner image transferred to a recording medium to be fixed to the recording medium.

16. The image forming apparatus according to claim 15, wherein the supporting column portion is provided on one side of the image forming portion, and wherein the fixing device is located at an upper position on one side inside the image forming portion.

17. The image forming apparatus according to claim 1, wherein a projecting portion projecting from the image reading portion is inserted in an insertion portion provided in the supporting column portion.

18. The image forming apparatus according to claim 1, wherein the supporting body comprises:

a first supporting portion provided with the duct portion and fixed to a side surface of the housing for supporting the image reading portion; and a second supporting portion extending from the first supporting portion in the same direction as the cantilevered manner supported image reading portion;

wherein a receiving portion for fixing the second supporting portion in place is provided on the side surface of the housing.

19. The image forming apparatus according to claim 18, wherein the receiving portion is a frame body fixed to and provided on the side surface of the housing, and wherein the second supporting portion is fixed to the frame body.

20. The image forming apparatus according to claim 1, wherein the supporting body comprises:

a first supporting portion provided with the duct portion and fixed to a side surface of the housing for supporting the image reading portion; and a second supporting portion extending from the first supporting portion in the same direction as the cantilevered manner supported image reading portion;

wherein a receiving portion for fixing the second supporting portion in place is provided on the side surface of the housing.

21. The image forming apparatus according to claim 20, wherein the receiving portion is a frame body fixed to and provided on the side surface of the housing, and wherein the second supporting portion is fixed to the frame body.

22. The image forming apparatus according to claim 1, wherein the supporting column portion extends from the top of the image forming portion.

23. The image forming apparatus according to claim 1, wherein the image reading portion is hingedly connected to the supporting column portion.

24. The image forming apparatus according to claim 1, wherein the image reading portion, the image forming portion and the supporting column portion are fixed to one another.

25. The image forming apparatus according to claim 1, wherein a rectifying plate is structured in the supporting column, and the rectifying plate makes an upper space of the supporting column narrower than a lower space of the supporting column.

26. An image forming apparatus wherein an image reading portion is provided in spaced relationship with a top surface of an image forming portion, the apparatus comprising:

a supporting column portion provided on the image forming portion and supporting the image reading portion in a cantilevered manner;

a tubular duct portion provided inside the supporting column portion with an axial direction being substantially a vertical direction;

an exhaust port provided at the supporting column portion for exhausting air from the duct portion; and an intake port provided below the exhaust port for delivering air from inside the image forming portion to the duct portion;

wherein the supporting column portion comprises a supporting body having the duct portion, and wherein the supporting body is fixed to a top portion of a housing of the image forming portion;

wherein the supporting body comprises:

a first supporting portion provided with the duct portion and fixed to a side surface of the housing, for supporting the image reading portion; and a second supporting portion extending from the first supporting portion in the same direction as the cantilevered manner supported image reading portion;

wherein a receiving portion for fixing the second supporting portion in place is provided on the side surface of the housing; and wherein the receiving portion is a frame body fixed to and provided on the side surface of the housing, and wherein the second supporting portion is fixed to the frame body.

* * * * *